US010602829B2

(12) United States Patent
Xiong

(10) Patent No.: US 10,602,829 B2
(45) Date of Patent: Mar. 31, 2020

(54) CARTRIDGE OF OIL-FREE LIP BALM

(71) Applicant: Cheobe (Dongguan) Package Co., Ltd., Dongguan, Guangdong Province (CN)

(72) Inventor: Jieping Xiong, Dongguan (CN)

(73) Assignee: Choebe (Dongguan) Package Co., Ltd., Guangdong Province (CN)

( * ) Notice: Subject to any disclaimer, the term of this patent is extended or adjusted under 35 U.S.C. 154(b) by 22 days.

(21) Appl. No.: 15/945,777

(22) Filed: Apr. 5, 2018

(65) Prior Publication Data

US 2018/0289130 A1 Oct. 11, 2018

(30) Foreign Application Priority Data

Apr. 7, 2017 (CN) ..... 2017 2 0365573 U

(51) Int. Cl.

| | |
|---|---|
| ***B43K 21/08*** | (2006.01) |
| ***A45D 40/04*** | (2006.01) |
| ***A45D 40/06*** | (2006.01) |
| ***A45D 40/02*** | (2006.01) |
| *A45D 40/00* | (2006.01) |
| *A45D 40/20* | (2006.01) |

(52) U.S. Cl.

CPC ..... *A45D 40/04* (2013.01); *A45D 40/02* (2013.01); *A45D 40/023* (2013.01); *A45D 40/06* (2013.01); *A45D 40/065* (2013.01); *A45D 2040/0025* (2013.01); *A45D 2040/208* (2013.01)

(58) Field of Classification Search

CPC ..... A45D 40/02; A45D 40/023; A45D 40/04; A45D 40/06; A45D 40/065; A45D 2040/208

USPC ..... 401/75, 78

See application file for complete search history.

(56) References Cited

U.S. PATENT DOCUMENTS

| | | | | |
|---|---|---|---|---|
| 2,698,085 A * | 12/1954 | Schall | A45D 40/06 401/78 |
| 5,186,561 A * | 2/1993 | Ackermann | A45D 40/06 401/194 |
| 5,842,805 A * | 12/1998 | Pierpont | A45D 40/06 401/78 |
| 6,244,770 B1 * | 6/2001 | Holloway | A45D 40/06 401/75 |
| 6,623,198 B2 * | 9/2003 | Holloway | A45D 40/12 401/75 |
| 9,814,294 B2 * | 11/2017 | Hermouet | A45D 40/065 |

* cited by examiner

*Primary Examiner* — Jennifer C Chiang

(74) *Attorney, Agent, or Firm* — Alan D. Kamrath; Mayer & Williams PC

(57) ABSTRACT

A cartridge of an oil-free lip balm includes a sleeve, an inner body arranged on the sleeve and a tube base arranged on the inner body and in threaded connection to the sleeve. The sleeve drives the tube base to axially move along the inner body. The inner body includes a base and a limiting tube connected to the base, the limiting tube is arranged in a hollow manner. The limiting tube is provided with a plurality of limiting grooves extending in an axial direction. The tube base is provided with one or more bulges. The tube base is provided with outer threads. The tube base is arranged in the limiting tube of the inner body. The bulges on the tube base transversely passes through the limiting grooves. The outer threads are in threaded connection to inner threads on the sleeve.

6 Claims, 2 Drawing Sheets

CARTRIDGE OF OIL-FREE LIP BALM

FIELD OF THE INVENTION

The invention relates to the field of cosmetics package, and more particularly to a cartridge of oil-free lip balm.

BACKGROUND OF THE INVENTION

Lubricating oil or lubricating additive is adopted as a buffer lubrication medium of a common cartridge when the cartridge rotates. But a method in which lubricating oil is adopted has the defects, such as complicated process and easy pollution, and thus cannot meet the actual needs of consumption. Therefore, the production enterprises adopt an oil-free cartridge structure instead of a traditional cartridge. However, the existing oil-free cartridge is relatively complicated in structure and inconvenient to dismount during production or use because of the use of more components, and the complicated component structure further improves the production cost, increases the economic burden of consumers and is not conductive to product promotion.

SUMMARY OF THE INVENTION

The invention provides a cartridge of an oil-free lip balm against the defects of the prior art.

The technical solution of the invention is as follows: a cartridge of an oil-free lip balm comprises a sleeve, an inner body arranged on the sleeve and a tube base arranged on the inner body and in threaded connection to the sleeve, wherein the sleeve drives the tube base to axially move along the inner body; the inner body comprises a base and a limiting tube connected to the base, wherein the limiting tube is arranged in a hollow manner, and a side surface of the limiting tube is provided with a plurality of limiting grooves extending in an axial direction; the tube base is provided with one or more bulges, wherein an outside surface of each bulge is provided with outer threads; the tube base is arranged in the limiting tube of the inner body; the bulge on the tube base transversely passes through the limiting grooves; the outer threads on the bulge are in threaded connection to inner threads on the sleeve.

Further, two ends of the limiting tube are respectively provided with a first opening and a second opening which are communicated with the limiting grooves, wherein the first opening is formed in the bottom end of the limiting tube, and the second opening is formed in the upper end of the limiting tube.

Further, the first opening and the second opening are arranged in reverse directions; when the position of the tube base is adjusted to a bottommost end, the bulge is clamped into the second opening; when the position of the tube base is adjusted to a topmost end, the bulge is clamped into the first opening.

Further, an upper end surface of the limiting tube is further provided with one or more mounting holes which are communicated with part of the limiting grooves.

Further, a clamping groove is formed in the middle of an outside surface of the base and arranged around the outside surface in the middle of the base; the sleeve is also arranged in a hollow manner; an annular bulge is arranged on an inside surface of the sleeve; the annular bulge inside the sleeve is clamped onto the clamping groove.

Further, the tube base comprises a mounting section and a clamping section, wherein an outer diameter of the mounting section is larger than that of the clamping section; a clamping surface is formed between the mounting section and the clamping section; an upper end surface of the base is provided with a downward penetrating hole; a step surface is formed between the limiting tube and the base; when the position of the tube base is adjusted to a bottommost end, the clamping surface on the tube base props against the step surface of the inner body.

The invention has the following beneficial effects: by arranging the outer threads on the bulge, arranging the outer threads matched therewith on the sleeve and enabling the inner threads on the tube base to be matched with the outer threads of the sleeve with each other, the limiting grooves guide the bulge on the tube base, such that the tube base axially moves along the limiting tube. The cartridge disclosed by the invention is simple in structure, effectively reduces the structure size of the cartridge of the lip balm, simplifies the assembly process and effectively reduces the production cost. In addition, the tube base and the sleeve are matched smoothly by means of a threaded fit manner, without additionally adding lubricating oil.

DETAILED DESCRIPTION OF THE PREFERRED EMBODIMENTS

In order to make the technical solution of the invention more clearly expressed, the invention will be further described with reference to the accompanying drawings.

Figure 1:
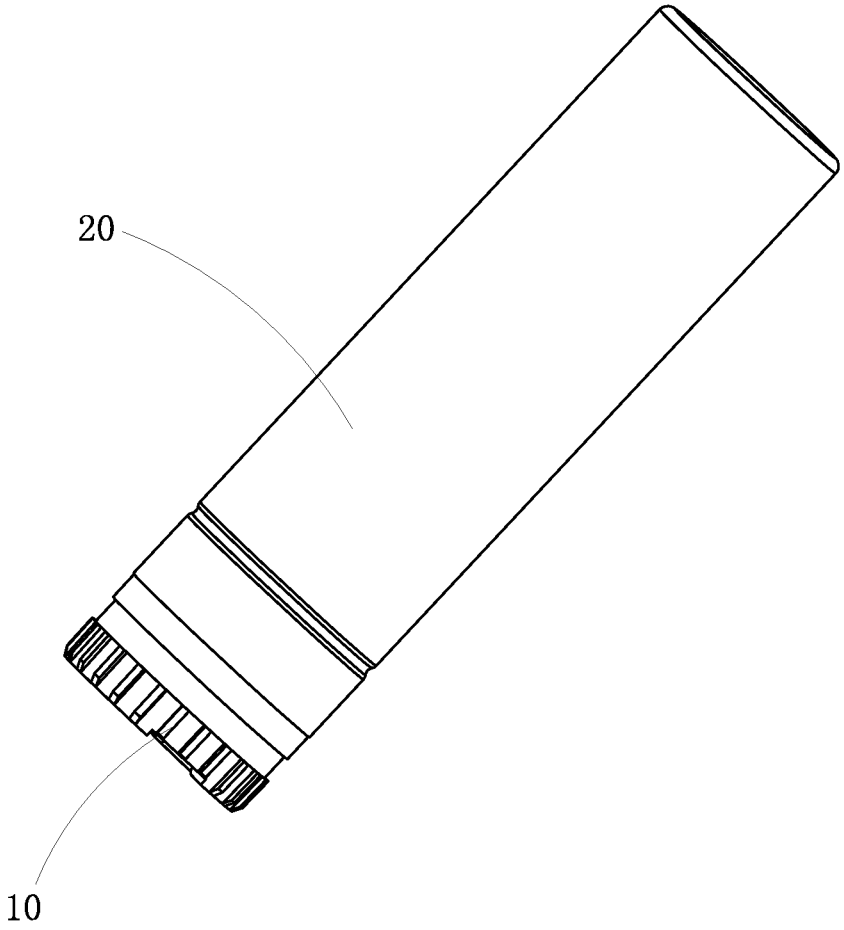
FIG. 1 is a schematic structural drawing of a cartridge of an oil-free lip balm according to the invention.
Figure 2:
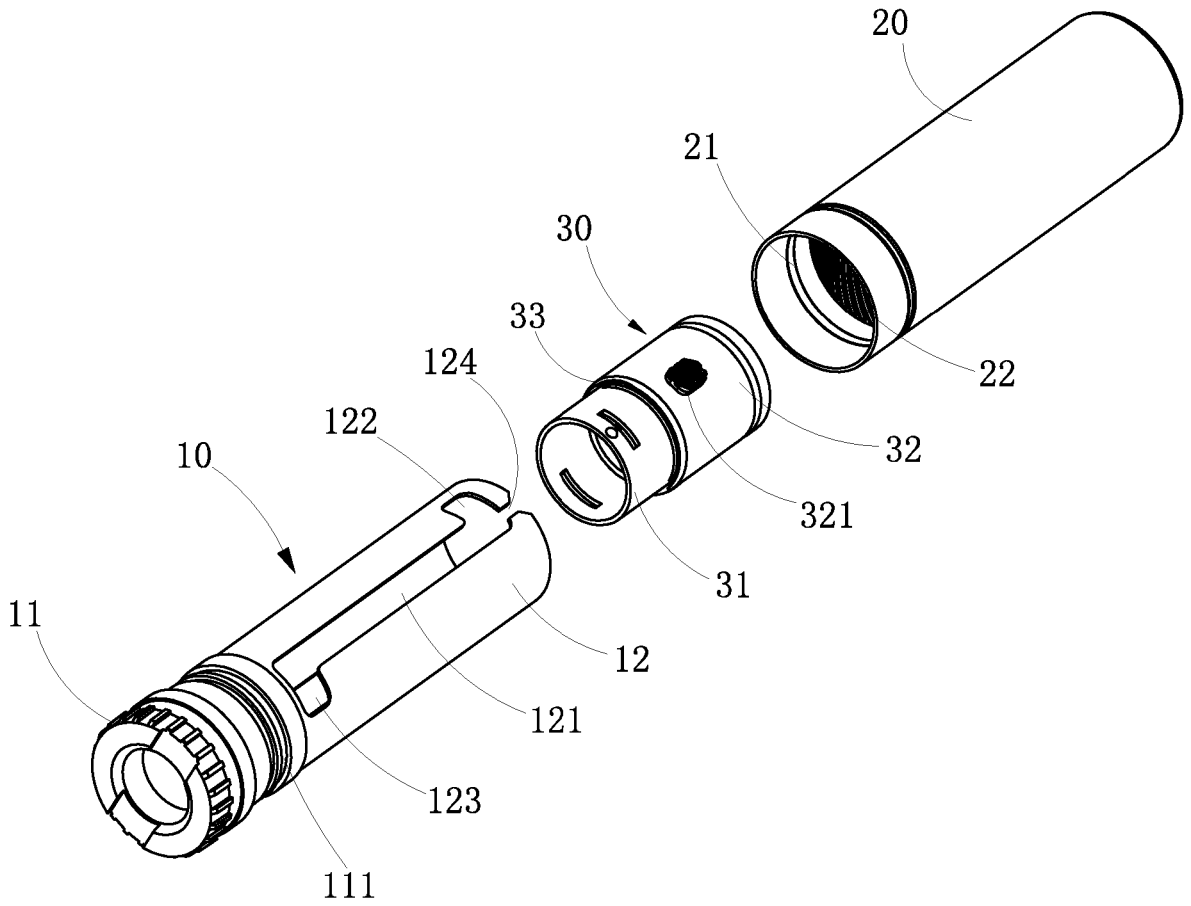
FIG. 2 is an exploded drawing of the cartridge of the oil-free lip balm as shown in FIG. 1.

As shown in FIGS. 1 to 2, the invention provides a cartridge of oil-free lip balm, which is used as a driving carrier when the lip balm is packaged. When the cartridge is used, the position of the lip balm is adjusted in a telescopic manner by using the cartridge. The cartridge of the oil-free lip balm comprises a sleeve 20, an inner body 10 arranged on the sleeve 20, a tube base 30 arranged on the inner body 10 and in threaded connection to the sleeve 20, wherein the sleeve 20 drives the tube base 30 to axially move along the inner body 10.

The inner body 10 comprises a base 11 and a limiting tube 12 integrally connected to the base 11, wherein the limiting tube 12 is arranged in a hollow manner. A side surface of the limiting tube 12 is provided with a plurality of limiting grooves 121 extending in an axial direction. Two ends of the limiting groove 121 are respectively provided with a first opening 122 and a second opening 123 which are communicated with the limiting grooves 121, wherein the second opening 123 is formed in a bottom end of the limiting tube 12, the first opening 122 is formed in an upper end (the end away from the base 11) of the limiting tube 12, and the first opening 122 and the second opening 123 are arranged in reverse directions. An upper end surface of the limiting tube 12 is further provided with one or more mounting holes 124 which are communicated with part of the limiting grooves 121. In the present embodiment, there are two limiting grooves 121. The two limiting grooves 121 in the limiting tube 12 are oppositely arranged. The limiting tube 12 is provided with a mounting hole 124 which is communicated with one limiting groove 121 in the limiting tube 12. A clamping groove 111 is formed in the middle of an outside surface of the base 11 and arranged around the outside surface in the middle of the base 11. A step surface (not shown) is formed between the limiting tube 12 and the base 11.

The tube base 30 is arranged in a hollow manner. The tube base 30 comprises a mounting section 31 and a clamping section 32, wherein an outer diameter of the mounting section 31 is smaller than that of the clamping section 32. A clamping surface 33 is formed between the mounting section 31 and the clamping section 32. A plurality of bulges (not shown) are arranged on an outside surface of the clamping section 32. An outside surface of each bulge of the clamping section 32 is provided with outer threads 321.

The sleeve 20 is also arranged in a hollow manner, and the bottom of the sleeve 20 is recessed inwards, such that an annular groove is formed in the outside surface of the sleeve 20. Correspondingly, an annular bulge 21 is formed on the inside surface of the sleeve 20. The inside surface of the sleeve 20 is provided with inner threads 22 which correspond to the outer threads 321 on the clamping section 32.

In the assembling process, the tube base 30 is arranged inside the limiting tube 12 of the inner body 10; the bulges on the tube base 30 passes through the mounting hole 124 and is clamped inside the limiting grooves 121; the limiting tube 12 extends into the sleeve 20 from the bottom end; the annular bulge 21 inside the sleeve 20 is clamped onto the clamping groove 111; the bulges on the tube base 30 transversely pass through the limiting grooves 121 and the outer threads 321 are in threaded connection to the inner threads 22 on the sleeve 20.

In the adjusting process, the sleeve 20 is clamped, and the base 11 of the inner body 10 is rotated, such that the inner threads 22 of the sleeve 20 are matched with the outer threads 321 of the tube base 30. The limiting groove 121 guides the bulge on the tube base 30, such that the tube base 30 moves axially along the limiting tube 12. When the position of the tube base 30 is adjusted to the bottommost end, the bulge is clamped into the second opening 123, and the clamping surface 33 of the tube base 30 props against the step surface of the inner body 10. Correspondingly, when the position of the tube base 30 is adjusted to the topmost end, the bulge is clamped into the first opening 122.

The invention has the beneficial effects: by enabling the inner threads 22 on the sleeve 20 to be matched with the outer threads 321 of the tube base 30, the limiting grooves 121 guide the bulge on the tube base 30, such that the tube base 30 axially moves along the limiting tube 12. The cartridge disclosed by the invention is simple in structure, effectively reduces the structure size of the cartridge of the lip balm, simplifies the assembly process and effectively reduces the production cost. In addition, the tube base 30 and the sleeve 20 are matched smoothly by means of a threaded fit manner, without additionally adding lubricating oil.

The embodiments described above are merely illustrative of one implementation of the present invention and are more specific and detailed, but are not to be construed as limiting the scope of the present invention. It should be noted that, for those common skilled in the art, several deformations and improvements made without departing from the concept of the present invention will fall into the protection scope of the present invention. Therefore, the scope of protection of the invention patent shall be subject to the appended claims.

What is claimed is:

1. A cartridge of an oil-free lip balm, comprising a sleeve, an inner body arranged on the sleeve and a tube base arranged on the inner body and in threaded connection to the sleeve, wherein the sleeve drives the tube base to axially move along the inner body; the inner body comprises a base and a limiting tube connected to the base, wherein the limiting tube is arranged in a hollow manner, and a side surface of the limiting tube is provided with a plurality of limiting grooves extending in an axial direction; the tube base is provided with outer threads; the tube base is arranged in the limiting tube of the inner body; the outer threads of the tube base are in threaded connection to inner threads on the sleeve.

2. The cartridge of the oil-free lip balm according to claim 1, wherein two ends of the limiting tube are respectively provided with a first opening and a second opening which are communicated with the limiting grooves, wherein the second opening is formed in the bottom end of the limiting tube, and the first opening is formed in the upper end of the limiting tube.

3. The cartridge of the oil-free lip balm according to claim 1, wherein the first opening and the second opening are arranged in reverse directions; when the position of the tube base is adjusted to a bottommost end, the bulge is clamped into the second opening; when the position of the tube base is adjusted to a topmost end, the bulge is clamped into the first opening.

4. The cartridge of the oil-free lip balm according to claim 1, wherein an upper end surface of the limiting tube is further provided with one or more mounting holes which are communicated with part of the limiting grooves.

5. The cartridge of the oil-free lip balm according to claim 1, wherein a clamping groove is formed in the middle of an outside surface of the base and arranged around the outside surface in the middle of the base; the sleeve is also arranged in a hollow manner; an annular bulge is arranged on an inside surface of the sleeve; the annular bulge inside the sleeve is clamped onto the clamping groove.

6. The cartridge of the oil-free lip balm according to claim 1, wherein the tube base comprises a mounting section and a clamping section, wherein an outer diameter of the mounting section is smaller than that of the clamping section; a clamping surface is formed between the mounting section and the clamping section.

* * * * *